United States Patent [19]

Coyle et al.

[11] Patent Number: 4,966,719

[45] Date of Patent: Oct. 30, 1990

[54] MULTIFUNCTIONAL MOLYBDENUM AND SULFUR CONTAINING LUBE ADDITIVES

[75] Inventors: Catherine L. Coyle, Mendham, N.J.; Mark A. Greaney, Upper Black Eddy, Pa.; Edward I. Stiefel, Bridgewater; Morton Beltzer, Westfield, both of N.J.

[73] Assignee: Exxon Research & Engineering Company, Florham Park, N.J.

[21] Appl. No.: 493,042

[22] Filed: Mar. 12, 1990

[51] Int. Cl.[5] ..... C10M 139/00

[52] U.S. Cl. ..... 252/42.7; 252/400.54

[58] Field of Search ..... 252/42.7, 400.54

[56] References Cited

U.S. PATENT DOCUMENTS

| | | | |
|---|---|---|---|
| 2,335,017 | 11/1943 | McNab et al. | 252/42.7 |
| 2,500,195 | 3/1950 | McDermott | 252/42.7 |
| 2,951,040 | 8/1960 | Hugel et al. | 252/33.6 |
| 3,356,702 | 12/1967 | Farmer et al. | 252/42.7 |
| 4,013,571 | 3/1977 | Williams et al. | 252/42 |
| 4,259,254 | 3/1981 | Bridger | 252/42.7 |

OTHER PUBLICATIONS

Hyde, J. et al., "Preparation and Characterization of Tetrakis (Thioxanthato) Molybdenum (IV) Complexes", J. Inorg. Nucl. Chem. 1977, vol. 39, pp. 289–296.

Vella, P. et al., "Preparation, Characterization and Electrochemical Investigation of Dimeric Molybdenum Thioxanthate Complexes", J. Inorg. Nucl. Chem. 1978, vol. 40, pp. 477–487.

*Primary Examiner*—Olik Chaudhuri
*Assistant Examiner*—Ellen McAvoy
*Attorney, Agent, or Firm*—Joseph J. Dvorak

[57] ABSTRACT

In accordance with this invention, there is provided a lubricating composition comprising a major amount of an oil of lubricating viscosity and a minor amount of an additive having the formula $MoL_4$ wherein L is a ligand selected from thioxanthates and mixtures thereof and, in particular, thioxanthates having a sufficient number of carbon atoms to render the additive soluble in the oil. In general, the thioxanthate ligand, L, will have from about 2 to about 30 carbon atoms.

11 Claims, No Drawings

MULTIFUNCTIONAL MOLYBDENUM AND SULFUR CONTAINING LUBE ADDITIVES

FIELD OF THE INVENTION

This invention relates to improved lubricating compositions.

BACKGROUND OF THE INVENTION

Molybdenum disulfide is a known lubricant additive. Unfortunately, it has certain known disadvantages which are associated with the fact that it is insoluble in lubricating oils. Therefore, oil soluble molybdenum sulfide containing compounds have been proposed and investigated is lubricant additives. For example, in U.S. Pat. No. 2,951,040, an oil soluble molybdic xanthate is disclosed as being useful in lubricating compositions. Apparently, the molybdic xanthate decomposes under conditions of use to form an oil insoluble molybdenum sulfide on the metal surfaces being lubricated.

U S. Pat. No. 4,013,571 discloses the use of certain thiosulfenyl xanthates in ashless lubricant compositions.

U.S. Pat. No. 4,259,254 discloses the use of xanthate containing molybdenum compounds in lubricating oil compositions.

U.S. Pat. No. 4,369,119 discloses an antioxidant additive for lubricating oils which is prepared by reacting an acidic molybdenum compound with a basic nitrogen compound and a sulfur compound and combining that product with an organic sulfur compound. In this regard, see also U.S. Pat. Nos. 4,395,343 and 4,402,840.

U.S. Pat. No. 4,474,673 discloses antifriction additives for lubricating oils which are prepared by reacting a sulfurized organic compound having an active hydrogen or potentially active hydrogen with molybdenum halide.

U.S. Pat. No. 4,497,719 discloses the use of metal salts of thiadiazole, such as molybdenum salts of thiadiazole as antiwear lube additives.

The foregoing patents are listed as representative of the many known molybdenum sulfur containing lubricant additives.

As is known in the art, some lubricant additives function as antiwear agents, some as antifriction agents and some as extreme pressure agents. Indeed, some additives may satisfy more than one of these functions. For example, metal dialkyl dithiophosphates represent a class of additives which are known to exhibit antioxidant and antiwear properties. The most commonly used additives of this class are the zinc dialkyl dithiophosphates. These compounds provide excellent oxidation resistance and exhibit superior antiwear properties. Unfortunately, they do not have the most desirable lubricity. Therefore, lubricating compositions containing these compounds also require the inclusion of antifriction agents. This leads to other problems in formulating effective lubricant compositions.

Additionally, extreme care must be exercised in combining various additives to assure both compatibility and effectiveness. For example, some antifriction agents affect the metal surfaces differently than the antiwear agents. If each type of additive is present in a lubricant composition, each may compete for the surface of the metal parts which are subject to lubrication. This can lead to a lubricant that is less effective than expected based on the properties of the individual additive components.

Thus, there still remains a need for improved lubricating oil additives that can be used with standard lubricating oils and that are compatible with other conventional components of the lubricating oil compositions.

SUMMARY OF THE INVENTION

In accordance with this invention, there is provided a lubricating composition comprising a major amount of an oil of lubricating viscosity and a minor amount of an additive having the formula $MoL_4$ wherein L is a ligand selected from thioxanthates and mixtures thereof and, in particular, thioxanthates having a sufficient number of carbon atoms to render the additive soluble in the oil. In general, the thioxanthate ligand, L, will have from about 2 to about 30 carbon atoms.

The amount of additive employed in the composition of the present invention will range from about 0.1 to about 10 wt. % based on the weight of oil and, preferably, in the range of about 0.1 to about 1.0 wt. %.

The lubricant compositions according to this invention have excellent antiwear, antioxidant and friction reducing properties. The lubricant compositions of the present invention also are compatible with other standard additives used in formulating commercial lubricating compositions.

DETAILED DESCRIPTION OF THE INVENTION

The lubricating composition of the present invention includes a major amount of an oil of lubricating viscosity. This oil may be selected from naturally occurring mineral oils or from synthetic oils. The oils may range in viscosity from light distillate mineral oils to heavy lubricating oils such as gas engine oil, mineral lubricating oil, motor vehicle oil and heavy duty diesel oil. In general, the viscosity of the oil will range from about 5 centistokes to about 26 centistokes, and especially in the range of 10 centistokes to 18 centistokes at 100° C.

The lubricating composition of the present invention includes a minor amount of an additive having the formula $MoL_4$ in which L is a thioxanthate ligand and preferably in which the number of carbon atoms in the ligand is sufficient to render the additive soluble in oil. For example, the additive will have the formula $$Mo(RSCS_2)_4$$

wherein R is an organo group selected from alkyl groups, aryl, aralkyl groups, alkoxylalkyl groups and the like. When R is an alkyl group, the number of carbon atoms in the alkyl group will generally range between about 1 to about 30 and, preferably, between about 8 to 20.

The additives of the present invention may be prepared by generally known techniques such as that described in *J. Inorg. Nucl. Chem. Lett.;* 39, 289 (1977). Alternatively, an alkali metal thioxanthate may be reacted with molybdenum pentachloride to produce the $MoL_4$ compound in a manner similar to the preparation of molybdenum tetramethylenedithiocarbamates disclosed in *J.C.S. Dalton,* 1614 (1972).

The above described $MoL_4$ compounds are effective as additives in lubricating compositions when they are used in amounts ranging from about 0.01 to 10 wt. % based on the weight of the lubricating oil and, preferably, in concentrations ranging from about 0.1 to 1.0 wt. %.

Concentrates of the additive of the present invention in a suitable diluent hydrocarbon carrier provide a convenient means of handling the additives before their use. Aromatic hydrocarbons, especially toluene and xylene, are examples of suitable hydrocarbon diluents for additive concentrates. These concentrates may contain about 1 to 90 wt. % of the additive based on the weight of diluent, although it is preferred to maintain the additive concentration between about 20 and 70 wt. %.

If desired, other known lubricant additives can be used for blending in the lubricant compositions of this invention. These include ashless dispersants detergents, pour point depressants, viscosity improvers and the like. These can be combined in proportions known in the art.

The invention will be more fully understood by reference to the following preparative procedures, examples and comparative examples illustrating various modifications of the invention, which should not be construed as limiting the scope thereof.

General Procedure for Preparation of $MoL_4$ Compounds

To demonstrate the preparation of $MoL_4$ compounds in which L is a thioxanthate, the preparation of Mo (dodecylthioxanthate)$_4$ will be described.

2.5 g (8 mmol) of potassium dodecylthioxanthate was dissolved in 100 ml of degassed toluene and added to 0.50 g (1.8 mmol) of $MoCl_5$. The mixture was stirred for 18 hours under nitrogen at 25° C. to produce a dark blue solution of the Mo (dodecylthioxanthate)$_4$. The product is separated by removal of the solvent. Purification was achieved by first extracting the crude product with 25 ml of hexane and filtering to isolate a first crop of pure product. A second crop of pure product was then isolated by loading the hexane filtrate on a column of silica and deluting with 9:1 hexane/methylene chloride. The blue band contains pure Mo(dodecylthioxanthate)$_4$ which can be isolated by solvent removal in vacuo. The product was identified by elemental analysis and UV-Vis spectral analysis.

Elemental analysis was: observed (calculated) C=51.71 (51.91); H=8.34 (8.31); S=32.08 (31.98); Mo=7.68 (7.98)

The UV-Vis spectrum in methylene chloride exhibits maxima at 245, 295, 450, 500 and 610 mm.

EXAMPLE 1

This example illustrates the antiwear properties of a lubricating composition containing a molybdenum tetrathioxanthate in accordance with the invention.

In this example, the additive prepared by the procedure outlined above was evaluated for wear protection using the Four-Ball Wear Test procedure (ASTM Test D2266). In Example 1, the sample tested consisted of Solvent 150 Neutral (S150) lubricating oil and 0.5 wt. % of the $MoL_4$ additive. The test was conducted for 45 minutes at 100° C., 1200 RPM with a 60 g load. The results of the test are given in Table 1.

COMPARATIVE EXAMPLES 1 and 2

In Comparative Example 1, the Four-Ball Wear Test procedure performed in Example 1 was also conducted using Solvent 150 Neutral. In Comparative Example 2, the test was repeated using Solvent 150 Neutral containing 1.4 wt. % of zinc dithiodiphosphate (ZDDP).

TABLE 1

| Run | Oil | Additive | Wt. % | Wear Volume $mm^3 \times 10^4$ | % Wear Reduction |
|---|---|---|---|---|---|
| Ex. 1 | S150N | $MoL_4$ | .5 | 8 | 98.5 |
| Comp. Ex. 1 | S150N | None | — | 540 | — |
| Comp. Ex. 2 | S150N | ZDDP | 1.4 | 29 | 94.6 |

EXAMPLE 2

A differential scanning calorimetry (DSC) test was conducted on a lubricating oil containing the additive of this invention. In this DSC test, a sample of the oil is heated in air at a programmed rate; e.g., 5° C./minute and the sample temperature rise relative to an inert reference was measured. The temperature at which an exothermic reaction (the oxidation onset temperature) is a measure of oxidative stability of the sample. In this Example 2, the sample consisted of S150N and 0.5 wt. % of the $MoL_4$ additive prepared as outlined above. The results of this test are shown in Table 2 below.

COMPARATIVE EXAMPLES 3 and 4

For comparative purposes, the DSC test and the lube stability test were conducted on samples of S150N (Comp. Ex. 3) and a fully formulated commercial motor oil (Comp. Ex. 4). The results of this test are also given in Table 2 below.

TABLE 2

| Run | Oil | Additive | Wt. % | DSC Oxidation Onset Temp. °C. |
|---|---|---|---|---|
| Ex. 2 | S150N | $MoL_4$ | .5 | 276 |
| Comp. Ex. 3 | S150N | None | — | 210 |
| Comp. Ex. 4 | CB | N/A | — | 275 |

(1) CB = Commercially blended motor oil
(2) N/A = Not applicable

EXAMPLE 3

This example illustrates the friction reducing properties of the lubricating compositions of this invention.

For the purpose of this example, friction measurements were performed in a ball on cylinder friction tester using S150N base oil containing 0.5 wt. % of $MoL_4$ where L is dodecylthioxanthate. This test employs a 12.5 mm diameter stationary ball and a rotating cylinder 43.9 mm in diameter. Both components were made from AISI 52100 steel. The steel balls were used in the heat treated condition with a Vickers hardness of 840, the cylinders used in the normalized condition with a Vickers hardness of 215.

The cylinder rotates inside a cup containing sufficient quantity of lubricant such that 2 mm of the cylinder bottom is submerged.

The test was performed for one hour at 100° C. with a 1.0 kg load and a 0.25 RPM rotation rate. The observed BOC friction coefficient was 0.11. Commercial friction modifiers in these ball on cylinder tests exhibit friction coefficients ranging from 0.12 to 0.14. S150N without any additives has a friction coefficient under these conditions of 0.28 and S150N with 1.4% ZDDP has a friction coefficient of 0.30.

The foregoing results demonstrate that the $MoL_4$ additives of the present invention are extremely effective anti-wear, anti-oxidant and friction modifying lubricant additives. As a bonus, all of these qualities are obtained with a phosphorous free formulation.

What is claimed is:

1. A lubricating composition comprising: a major amount of an oil of lubricating viscosity; and, a minor amount of an additive having the formula $MoL_4$ wherein L is a ligand selected from thioxanthates and mixtures thereof.

2. The composition of claim 1 wherein the ligand, L, has organo groups having a sufficient number of carbon atoms to render the additive soluble in the oil.

3. The composition of claim 2 wherein the amount of the additive is in the range of from about 0.01 to about 10 weight percent based on the weight of oil.

4. The composition of claim 3 wherein the organo groups are selected from alkyl, aryl, aralkyl and alkoxylalkyl groups.

5. The composition of claim 4 wherein the organo groups are alkyl groups and the number of carbon atoms in the alkyl groups of the ligand, L, are in the range of from about 1 to about 30.

6. A lubricating composition comprising: a major amount of an oil selected from natural and synthetic oils having viscosities in the range of from about 5 to about 26 centistokes at 100° C., and from about 0.01 to about 10 weight percent of an additive having the formula $MoL_4$, wherein L is a thioxanthate and mixtures thereof and wherein the ligand, L, has organo groups having from about 2 to about 30 carbon atoms.

7. The composition of claim 6 wherein the additive is present in an amount ranging from about 0.1 to about 1.0 weight percent.

8. The composition of claim 7 wherein the organo group is an alkyl group having from about 8 to about 20 carbon atoms.

9. The composition of claim 8 wherein the alkyl group has 12 carbon atoms.

10. An additive concentrate for blending with lubricating oils to provide a lubricating composition having improved properties comprising: a hydrocarbon diluent and from about 1 to about 90 weight percent of an additive, based on the weight of diluent, the additive having the formula $MoL_4$ wherein L is a ligand selected from thioxanthate and mixtures thereof and wherein the ligand, L, has organo groups having from about 2 to about 30 carbon atoms.

11. The concentrate of claim 10 wherein the diluent is an aromatic hydrocarbon and the additive ranges between about 20 to about 70 weight percent, based on the weight of diluent.

* * * * *